US005330009A

United States Patent [19]

Zhang

[11] Patent Number: 5,330,009

[45] Date of Patent: Jul. 19, 1994

[54] BUILT-UP INNER FLOATING CEILING, EQUIPPED WITH INSTANT FIRE EXTINGUISHING DEVICES, FOR USE IN AN OIL STORAGE TANK

[76] Inventor: Feng-Qiu Zhang, Room 101, Sichuan Mansion, Shenzhen, China

[21] Appl. No.: 945,531

[22] Filed: Sep. 16, 1992

[30] Foreign Application Priority Data

Sep. 17, 1991 [CN] China ..... 91 1 08843.1

[51] Int. Cl.[5] ..... A62C 3/00

[52] U.S. Cl. ..... 169/66; 169/26; 220/212; 220/216; 220/88.1

[58] Field of Search ..... 169/66, 68, 26; 220/216, 217, 218, 219, 220, 221, 212, 88.1

[56] References Cited

U.S. PATENT DOCUMENTS

| | | | |
|---|---|---|---|
| 2,079,438 | 5/1937 | Ellis | 169/66 |
| 2,757,744 | 8/1956 | Malone | 169/66 X |
| 3,687,329 | 8/1972 | Baum | 169/66 X |
| 3,741,309 | 6/1973 | McCulloch | 169/66 X |
| 3,896,881 | 7/1975 | DeBoer | 169/66 |
| 3,910,452 | 10/1955 | Szasz | 220/216 X |
| 4,018,356 | 4/1977 | Szasz et al. | 220/220 |
| 5,123,559 | 6/1992 | Qiu et al. . | |

FOREIGN PATENT DOCUMENTS

| | | | |
|---|---|---|---|
| 4000010 | 7/1990 | Fed. Rep. of Germany | 169/26 |
| 811658 | 4/1937 | France | 220/216 |

*Primary Examiner*—David M. Mitchell
*Assistant Examiner*—Gary C. Hoge
*Attorney, Agent, or Firm*—Merchant, Gould, Smith, Edell, Welter & Schmidt

[57] ABSTRACT

A kind of built-up inner floating ceiling, equipped with instant fire extinguishing devices, for use in an oil storage tank, consisting of a skeleton formed by girders, cover plates, radial beams, peripheral beams, plastic buoys, plate fixing beams, etc., said plastic buoys being made into a hollow structure, forming hollow chambers, where steel vessels filled with high-pressure inert gas are placed, said steel vessels being connected through connecting pipes fitted with left-handed screw caps and lock washers. As said screw caps are made of a low melting point material, in case of a fire, the will be melted at once, thus releasing the inert gas in said vessels, and extinguishing the fire.

10 Claims, 2 Drawing Sheets

BUILT-UP INNER FLOATING CEILING, EQUIPPED WITH INSTANT FIRE EXTINGUISHING DEVICES, FOR USE IN AN OIL STORAGE TANK

BACKGROUND OF INVENTION

The present invention relates to a kind of built-up inner floating ceiling for use in an oil storage tank, particularly one with instant fire extinguishing devices equipped in or on said ceiling.

In order to put out a fire occurring in an oil storage tank, usually some fire extinguishing devices are provided in the vicinity of said tank; normally, such devices are at a considerable distance from the tank. In case of a fire inside the tank, foamites are splashed onto the roof of said ceiling by means of high pressure pumping, and the fire will be put out only when said foamites have completely covered the roof. All existing inner floating roofs, such as steel roofs, aluminum roofs, as well as the "Built-up Inner Floating Ceiling for Use in An Oil Storage Tank", disclosed in U.S. application Ser. No. 07,703,013, which matured into U.S. Pat. No. 5,123,559 (Qiu et al.), all use the above-described fire extinguishing devices.

The main disadvantage of such devices is that it takes a substantially long period of time to complete the whole procedure, that is, to receive a fire alarm signal, to turn on the high pressure pump to splash enough foamites on to the roof, until said foamites have completely covered said roof. Any delay in the above steps may lead to a certain loss, or even a big disaster.

OBJECT OF INVENTION

The primary object of this invention is to provide instant fire extinguishing devices which can be equipped inside or on the roof, so as to put out a fire inside the tank immediately.

DESCRIPTION OF INVENTION

According to this invention, the afore-said object can be attained by making said plastic buoys into a hollow structure, forming hollow chambers along the periphery of the buoys, and then placing fire extinguishing devices in said hollow chambers. Said fire extinguishing device consists of steel vessels, filled with high pressure inertial gas and connected by connecting pipes which in turn are fitted with lock washers and screw caps, said screw caps being made of a low melting point material. As a fire in an oil storage tank usually happens in the connection area between the ceiling peripheries and the internal wall of the tank, when such a fire occurs, the screw caps are immediately melted and will fall off automatically, thus releasing the inert gas inside said steel vessels, to put out the fire. Said fire extinguishing devices can also be placed on top of said buoys, also close to the periphery.

Best Mode for Carrying Out the Invention

Figure 1:
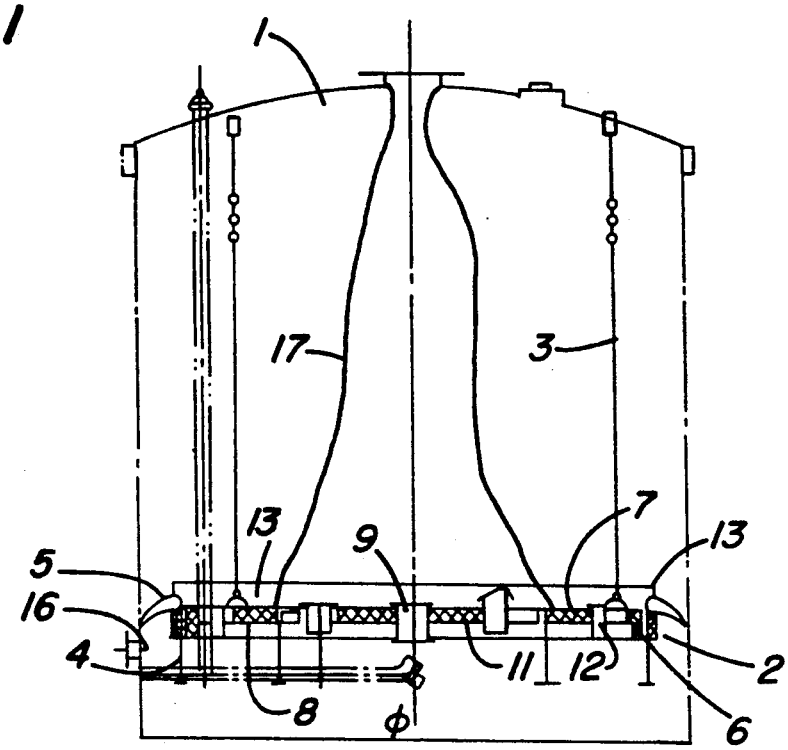
FIG. 1 illustrates a built-up inner floating ceiling mounted in a conventional oil storage tank.
Figure 2:
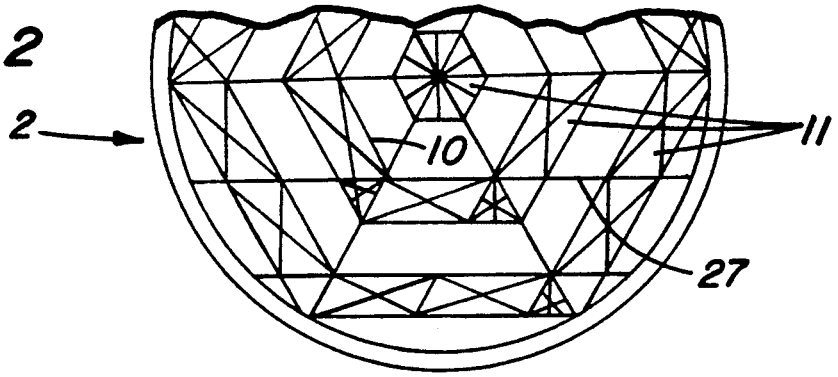
FIG. 2 is a top view of said ceiling, illustrated in FIG. 1.

As shown in FIGS. 1 and 2, a conventional inner floating ceiling 2, fitted inside an oil storage tank 1, comprises a skeleton of a radiate structure, said skeleton consisting of H-shaped radial beams 8 and peripheral beams 10 which are bolted together, said beams being all aluminum or steel beams. Plastic buoys 11, made of hard obturated foam plastic into the shape of a parallelogram or an equiliteral triangle, are fitted into the grooves of said beams and pressed by cover plates 7 on top, in contact with metallic nets 18 (see FIG. 3*a*) provided beneath, for removal of electrostatics. Preferably, hard obturated foam plastic of polyaminoester is used for the buoys, and a conductive additive is added to the material to decrease accumulation of electrostatic charges. Further provided are girded girders 6, bolted into an integral body and supported by supporting legs 4 which are used to adjust the assembling height of said girders. Said radial beams 8 are uniformly arranged at equal angular intervals, each with one end bolted to a girder 6 and the other end to a centre disk 9 fitted in the centre of said ceiling 2. Provided at top of said cover plates 7 are anti-rotational steel wires 3 and connecting wires 17. Connecting wires 17 are used for grounding of electrostatic charges. Moreover, there are provided fire-proof foam plates 13, tongue-shaped seals 5 and tongue-shaped seal fixing plates 15 (during assembly, plates 15 are used as templates to adjust the gap between the girders 6 and the tank's internal wall). Liquid discharge pipes 12 are also provided for discharging liquid. Depending on their location in the ceiling, said beams 8 and 10, plastic buoys 11, as well as supporting legs 4, are classified into central/middle/peripheral beams/-buoys/supporting legs. For detailed structure, assembling, etc., of such an inner floating ceiling, reference can be made to U.S. Pat. No. 5,123,559.

Further, the buoys are arranged concentrically and plate fixing beams 27 are fitted so that the vapour space between the floating ceiling and the liquid surface is divided into a multiple of small compartments by said radial, peripheral and plate fixing beams. This is advantageous because if vapour leakage should occur, such will be limited only to a certain compartment.

Figure 3A:
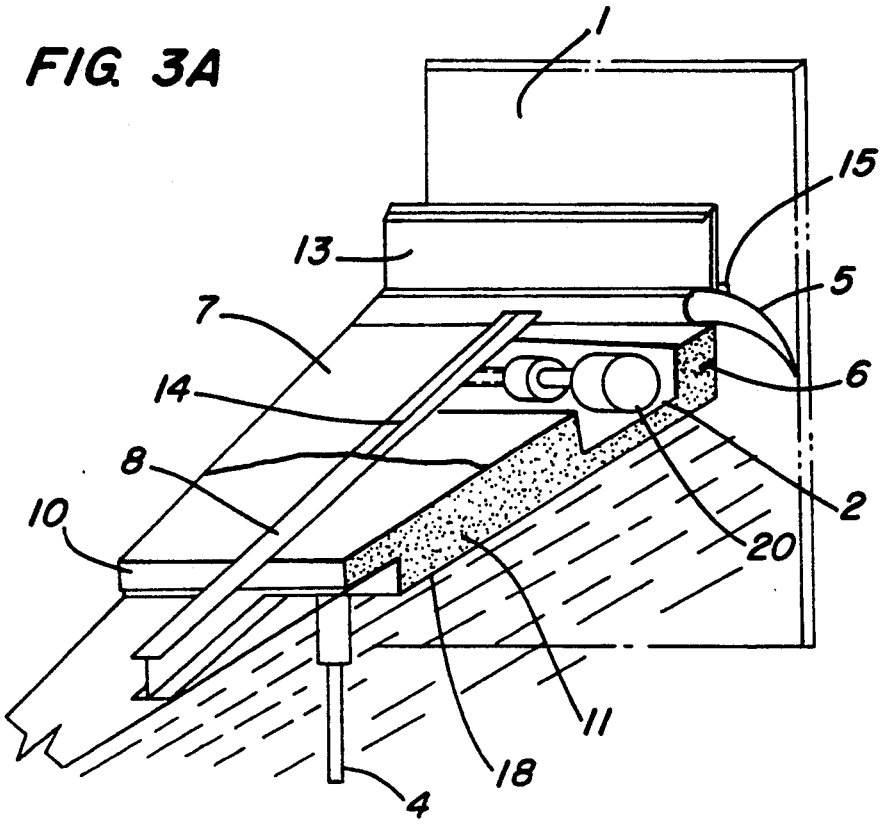
FIG. 3*a* is a sectional view of an inner floating ceiling, with fire extinguishing devices mounted inside the hollow chambers of the plastic buoys.

FIG. 3*a* shows the detailed structure of a best mode embodiment according to the present invention, where the steel vessels 20 containing high pressure inert gas are placed inside a number of hollow chambers formed along and close to the periphery in said peripheral plastic buoys 11.

Figure 3B:
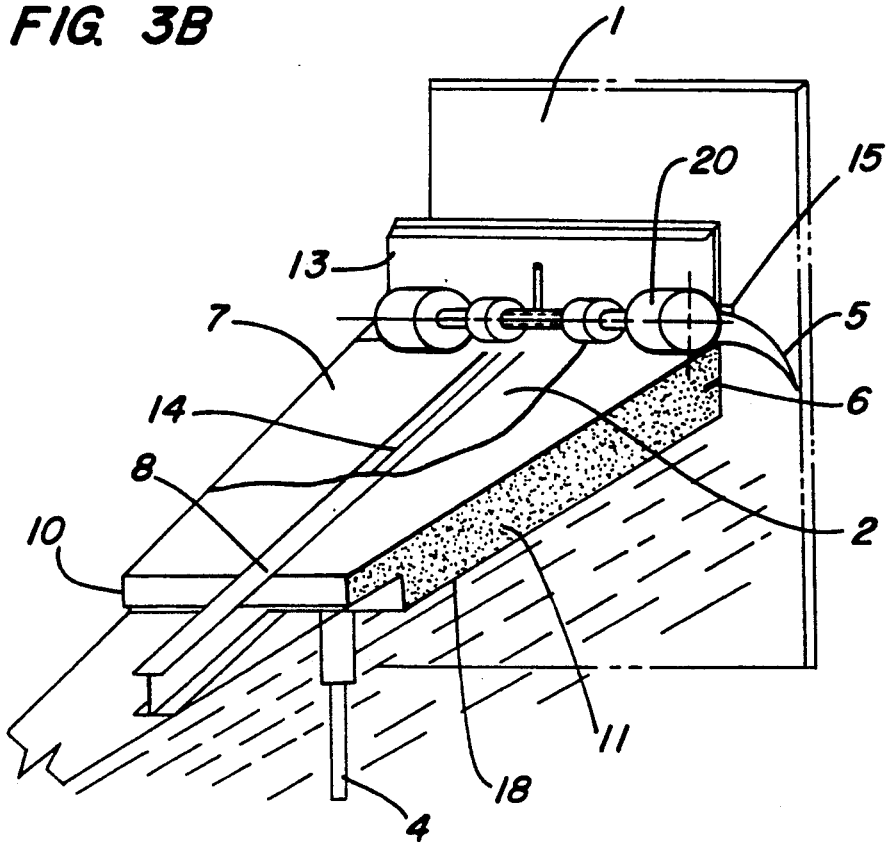
FIG. 3*b* is an illustration of an inner floating ceiling, with fire extinguishing devices mounted on top of the buoys' cover plates.

In another embodiment of the present invention, as shown in FIG. 3*b*, said steel vessels 20 are placed just on top of the cover plates 7 of said peripheral plastic buoys 11, also along and close to the periphery of said buoys.

Figure 4:
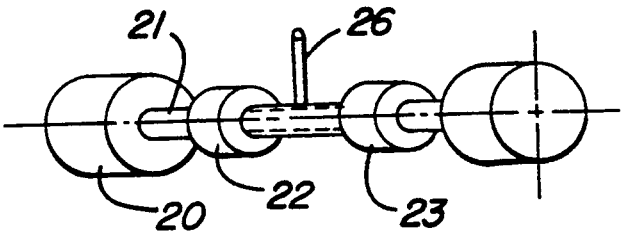
FIG. 4 is an illustration of said fire extinguishing device.

The fire extinguishing device in turn, as illustrated in FIG. 4, comprises steel vessels 20 which contains high pressure inertial gas, connecting pipes 21 and screw caps 22 and 23, fitted with sealing lock washers, and a gas filling pipe 26 connected to said connecting pipe. The peripheral plastic buoy 11 of said inner floating ceiling is made into a hollow structure, forming a hollow chamber along and close to the periphery in said buoys, where said fire extinguishing device is placed. Inert gas is filled from the gas filling pipe 26 through connecting pipes 21 into the steel vessels 20. When said vessels 20 are filled up, said pipe 26 will be automatically sealed (sealing structure of pipe 26 omitted here since it does not belong to the scope of the present invention), so that said gas will remain in said vessels without leaking. Said screw caps 22 and 23 are made of a material having a low melting point. When there is a fire, since the screw caps 22 and 23 are close to the periphery of the peripheral buoys 11 where a fire usually starts, they will immediately be melted, whereby the inert gas inside said vessels 20 will be released, to put out the fire at once.

Assembling procedures of the inner floating ceiling according to the present invention follow:

First, the girders 6 are carried into the oil tank through the manhole 16 (see FIG. 1). Further, the seal fixing plates 15 are used as templates to adjust so that the gap between the internal wall of the tank 1 and the outer periphery of the girders 6 is about 190 mm (for details of adjustment, refer to U.S. Pat. No. 5,123,559). Next, bolts are tightened so that the girders 6 are connected into an integral member. Legs 4 are then fitted into the respective holders at proper places of the girders 6 by means of screws.

Secondly, the centre disk 9 is taken into the tank 1, and a centre leg 4 is mounted to a holder at the bottom of said centre disk 9. In the mean time, the radial beams 8 are uniformly arranged each with one end bolted to a girder 6 and the other end to the centre disk 9. Plate fixing beams 27 are then evenly placed between said radial beams. All bolts are then tightened.

Thirdly, the central buoys 11 are wrapped in one or a multiple of layers of metallic net 18 and inlaid between two central radial beams 8. And the middle supporting legs 4 are screwed tight onto the middle peripheral beams 10. The middle and peripheral plastic buoys 11 are mounted in a similar manner.

The final assembling procedure depends on whether the fire extinguishing device is fitted inside the buoys or on top thereof:

To assemble the embodiment wherein the fire extinguishing devices are placed inside the hollow chambers of the peripheral plastic buoys, the steel vessels 20 are inserted into the pre-made hollow chambers inside said peripheral plastic buoys 11, and the connecting pipes 21, the seal lock washers, and the screw caps are fitted together. The screw caps 22 and 23 are then tightened. Next, the cover plates 7 are mounted in position and fixed with the pressing strips 14. The liquid discharge pipes 12 and other related fittings are then mounted into proper places on the ceiling 2. The anti-rotational steel wires 3 are fitted and wires 17 are connected propertly. Finally, the tongue-shaped seals 5 and the fire-proof foam plates 13 are mounted onto the bolts that connect the girders 6 and the seal fixing plates 15 are put on and tightened with nuts. The whole process of assembling an inner floating ceiling with fire extinguishing devices placed inside the peripheral buoys is thus completed.

b) To assemble the embodiment wherein the fire extinguishing devices are placed on top of the peripheral buoys, the cover plates 7 are mounted in position and fixed with the pressing strips 14. Steel vessels 20 are then fixed onto the cover plates 7 near the outer periphery of the peripheral buoys. The connecting pipes 21 and the seal lock washers are fitted and the screw caps 22 and 23 are tightened. Next, the liquid discharge pipes 12 and the related fittings are mounted in proper positions on the ceiling 2. The anti-rotational steel wires 3 are fitted and wires 17 are connected propertly. The tongue-shaped seals 5 and the fire-proof foam plates 13 are put on and tightened with nuts. The whole assembling process of an inner ceiling with fire extinguishing devices mounted on top of the peripheral buoys is thus completed.

Advantages of the Present Invention

1. Since the steel vessels filled with inert gas are placed along and close to the outer periphery of the peripheral plastic buoys, a fire which usually starts in the area between the outer periphery of the ceiling and the internal wall of the tank can be immediately put out. And then, because the plastic buoys, as mentioned in a previous Chinese patent CN 90 2 22442.5 (or corresponding U.S. Pat. No. 5,123,559), are made of hard foam plastic, it is very easy to pre-shape them into a hollow structure with hollow chambers formed.

2. Since the fire extinguishing devices are fitted right inside or on top of the peripheral buoys, independently provided fire extinguishing equipments are no longer needed, and their high costs can be avoided.

What is claimed is:

1. A built-up inner floating ceiling, equipped with instant fire extinguishing devices, for use in an oil storage tank, comprising:

a skeleton of radial structure, said skeleton consisting of H-shaped radial beams and peripheral beams which are bolted together;

foam plastic buoys, fitted into the grooves of said H-shaped beams and pressed by cover plates on top, and in contact with metallic nets provided beneath;

girded girders, bolted into an integral body and supported by supporting legs;

said radial beams being uniformly arranged at equal angular intervals, each with one end bolted to a girder and the other end bolted to a centre disk which is fitted in the centre of said inner floating ceiling;

further comprising anti-rotational wires and connecting wires, fitted between said cover plates and the top of the tank, and fire-proof foam plates, tongue-shaped seals and fixing plates for said seals, all fitted round the periphery of said ceiling;

the peripheral ones among said foam plastic buoys being made into a hollow structure, to form hollow chambers along and close to the periphery in said peripheral plastic buoys, which hollow chambers are used to place instant fire extinguishing devices.

2. A built-up inner floating ceiling, equipped with instant fire extinguishing devices, for use in an oil storage tank, as claimed in claim 1, wherein each of said fire extinguishing devices comprises steel vessels containing high pressure inertial gas, connecting pipes and screw caps, and a gas filling pipe connected to said connecting pipe; said screw caps being made of a material having a low melting point.

3. A built-up inner floating ceiling, equipped with instant fire extinguishing devices, for use in an oil tank, as claimed in claims 1 wherein said plastic buoys are made of hard foam plastic, said buoys being concentrically arranged, held by said radial, peripheral and plate fixing beams, which in turn divide the space between said ceiling and the liquid surface in said tank into a multiple of small compartments.

4. A built-up inner floating ceiling, equipped with instant fire extinguishing devices, for use in an oil tank, as claimed in claim 1, wherein said buoys are made of hard obturated foam plastic of polyaminoester, with a conductive additive added therein.

5. A built-up inner floating ceiling, equipped with instant fire extinguishing devices, for use in an oil storage tank, comprising:

a skeleton of radial structure, said skeleton consisting of H-shaped radial beams and peripheral beams which are bolted together;

foam plastic buoys, fitted into the grooves of said H-shaped beams and pressed by cover plates on top, and in contact with metallic nets provided beneath;

girded girders, bolted into an integral body and supported by supporting legs;

said radial beams being uniformly arranged at equal angular intervals, each with one end bolted to a girder and the other end bolted to a center disk which is fitted in the center of said inner floating ceiling;

anti-rotational wires and connecting wires, fitted between said cover plates in the top of the tank, and fire-proof foam plates, tongue-shaped seals and fixing plates for said seals, all fitted around the periphery of said ceiling; and instant fire extinguishing devices affixed to said peripheral plastic buoys.

6. A built-up inner floating ceiling, equipped with instant fire extinguishing devices, for use in an oil storage tank, as claimed in claim 5, wherein each of said fire extinguishing devices comprises steel vessels containing high pressure inert gas, connecting pipes and screw caps, and a gas filling pipe connected to said connecting pipe; said screw caps being made of a material having a low melting point.

7. A built-up inner floating ceiling, equipped with instant fire extinguishing devices, for use in an oil tank, as claimed in claim 5, wherein said plastic buoys are made of hard foam plastic, said buoys being concentrically arranged, held by said radial, peripheral and plate fixing beams, which in turn divide the space between said ceiling and the liquid surface in said tank into a multiple of small compartments.

8. A built-up inner floating ceiling, equipped with instant fire extinguishing devices, for use in an oil tank, as claimed in claim 5, wherein said buoys are made of hard obturated foam plastic of polyaminoester, with a conductive additive added therein.

9. A built-up inner floating ceiling, equipped with instant fire extinguishing devices, for use in an oil storage tank, as claimed in claim 5, wherein said fire extinguishing devices are placed proximate the periphery of said buoys.

10. A built-up inner floating ceiling, equipped with instant fire extinguishing devices, for use in an oil storage tank, as claimed in claim 5, wherein said fire extinguishing devices are placed on top of the cover plates on said peripheral plastic buoys.

* * * * *